US006169275B1

(12) United States Patent
Noda et al.

(10) Patent No.: US 6,169,275 B1
(45) Date of Patent: Jan. 2, 2001

(54) CERAMIC HEATER AND OXYGEN SENSOR USING THE SAME

(75) Inventors: Yoshiro Noda, Gifu; Toshihiko Aoyama, Aichi, both of (JP)

(73) Assignee: NGK Spark Plug Co, Ltd., Aichi (JP)

( * ) Notice: Under 35 U.S.C. 154(b), the term of this patent shall be extended for 0 days.

(21) Appl. No.: 09/325,173

(22) Filed: Jun. 3, 1999

(30) Foreign Application Priority Data

Jun. 5, 1998 (JP) ..... 10-173960
Mar. 15, 1999 (JP) ..... 11-068394

(51) Int. Cl.[7] ..... H05B 3/10

(52) U.S. Cl. ..... 219/552; 219/553; 219/542; 219/548

(58) Field of Search ..... 219/538, 541–548, 219/552, 553, 270; 204/130, 425, 426, 427; 338/34; 428/210, 697

(56) References Cited

U.S. PATENT DOCUMENTS 3,875,413 * 4/1975 Bridgham ..... 219/553
4,883,947 * 11/1989 Murase et al. ..... 219/553
4,952,903 * 8/1990 Shibata et al. ..... 338/34
5,068,517 * 11/1991 Tsuyuki et al. ..... 219/543
5,705,261 * 1/1998 Axelson ..... 428/210
5,801,361 * 9/1998 Willkens et al. ..... 219/270
5,965,051 * 10/1999 Hirayama et al. ..... 219/553
5,998,049 * 12/1999 Tanaka et al. ..... 428/697
6,008,479 * 12/1999 Jiang et al. ..... 219/553

FOREIGN PATENT DOCUMENTS 5-34313 2/1993 (JP) .
6-188065 7/1994 (JP) .
8-315967 11/1996 (JP) .
9-49818 2/1997 (JP) .
9-52784 2/1997 (JP) .
9-266059 10/1997 (JP) .

* cited by examiner

*Primary Examiner*—Tu Ba Hoang
(74) *Attorney, Agent, or Firm*—Brinks Hofer Gilson & Lione

(57) ABSTRACT

A ceramic heater with a specified ratio of electric resistance for the heat generating portion and the lead portion of a heat generating resistor is provided. The ceramic heater has a ceramic substrate comprising alumina as a main ingredient and a heat generating resistor composed only of tungsten, or a heat generating resistor comprising at least one of 3 to 30% by weight of alumina and 10 to 40% by weight of rhenium, and at least one of tungsten and molybdenum. Particularly, the ratio of the electric resistance can be controlled and the adhesion of ceramic substrates for sandwiching the heat generating resistor can be improved, for example, by means of disposing slits to the lead portion and/or changing ingredients constituting the lead portion. The ceramic heater is capable of reaching a predetermined temperature in a short time, has high adhesion between the heat generating resistor and ceramic substrates and excellent durability and can be used in an oxygen sensor.

12 Claims, 6 Drawing Sheets

CERAMIC HEATER AND OXYGEN SENSOR USING THE SAME

BACKGROUND OF THE INVENTION

1. Field of the Invention

The present invention concerns a ceramic heater and an oxygen sensor using the same. More specifically, the present invention concerns a ceramic heater in which the ratio of the electric resistivity between a heat generating portion and a lead portion of the heat generating resistor is specified and concerns an oxygen sensor using the same. The ceramic heater according to the present invention is useful, particularly, as a heater for use in an automobile oxygen sensor. Further, it can be used also as a glow system for use in internal combustion engines, a ceramic heater for heating semiconductors and a petroleum gasifying heat source used for petroleum fan heaters.

2. Description of the Related Art

A ceramic heater is generally manufactured by printing a paste containing a high melting point metal such as tungsten, molybdenum or platinum as a thick-film to the surface of a ceramic substrate of a desired shape such as a flat plate or a cylinder obtained by pressure molding or extrusion molding to form a heat generating resistor pattern, laminating another ceramic substrate thereon and sintering them integrally. A ceramic heater using alumina as a main ingredient constituting the ceramic substrate and tungsten as the high melting point metal and obtained by integrally sintering them is a typical example thereof. Since the ceramic heater is stable at a high temperature, it has been used, for example, in an application exposed to a high temperature such as an automobile oxygen sensor or a glow plug for use in internal combustion engines.

However, in automobile oxygen sensor applications, it has been required that an oxygen sensor operate rapidly after starting of an engine since regulations for exhaust gases have become severe recently. Hence, the oxygen sensor has to be heated rapidly and the temperature be increased rapidly to working temperature. Accordingly, it is necessary to use a heater having a high temperature elevation rate. Further, for an automobile oxygen sensor used in a severe circumstance in which it is exposed for a long time to a high temperature, it is also required that the heater to be used has an outstandingly excellent durability compared with conventional heaters.

As a ceramic heater of stable performance, Japanese Patent Unexamined Publication Hei 9-52784 discloses a ceramic heater having a heat generating resistor containing rhenium. In this heater, the temperature can be elevated easily and a stable performance can be obtained by the compounding of rhenium. Further, as a heater of high durability with less degradation of the performance even during long time use, Japanese Patent Unexamined Publication Hei 8-315967 discloses a ceramic heater with an alumina ingredient incorporated into a heat generating resistor. In this heater, adhesion between an alumina substrate and a heat generating resistor is improved to prevent defoliation of them thereby improving the durability. Further, Japanese Patent Unexamined Publication Hei 5-34313 discloses a ceramic heater having a heat generating resistor in which the temperature coefficient of resistance varies depending on the portions of the resistor. In this heater, the temperature elevation just after the application of voltage is rapid and a constant temperature is kept with no provision of an additional circuit.

However, in the ceramic heater having the heat generating resistor containing rhenium, as described in Japanese Patent Unexamined Publication Hei 9-52784, no particular consideration is made on the heater in that, after elevation to a predetermined temperature, the temperature is kept at a stationary state. Therefore, depending on circumstances, a control circuit for keeping the temperature within a predetermined range is required. Further, in the ceramic heater with the alumina ingredient incorporated into the heat generating resistor, as described in Japanese Patent Unexamined Publication Hei 8-315967, since the electric resistivity in the lead portion of the heat generating resistor is high, the temperature elevation rate in the heat generating portion is low, and the lead portion also sometimes shows considerable heat generation.

SUMMARY OF THE INVENTION

A ceramic heater according to the present invention comprises a ceramic substrate and a heat generating resistor disposed in the ceramic substrate, wherein the heat generating resistor has a heat generating portion and a lead portion and wherein the ratio of electric resistance of the heat generating portion to the total electric resistance of the heat generating portion and the lead portion at a normal temperature is from 55 to 95%.

For the ceramic substrate described above, it is preferred to use those having a high heat resistance and high strength at a high temperature. Ceramic substrates sandwich the heat generating resistor between them and shield them from atmospheric air to prevent oxidation and deterioration of the heat generating resistor.

Usually, alumina is used for such ceramic substrates. In addition, it may be mullite and spinel. Further, the ceramic substrate may be incorporated with other elements. In a case of a ceramic substrate comprising alumina as a main ingredient, it is particularly preferred to contain alumina by 80 parts by weight (hereinafter simply referred to as parts) or more (more preferably 85 parts or more and, more preferably, 91 parts or more) based on 100 parts by weight of the entire ceramic substrate. The ceramic substrate is excellent in sinterability and durability. Further, the ceramic substrate may contain elements belonging to group IV and group V of the periodic table, as well as oxides thereof.

The ceramic substrate may contain a sintering aid added for easy sintering. As the sintering aid, those mixed generally with a green material which is sintered into a ceramic substrate may be used. For instance, $SiO_2$, CaO and MgO, as well as those forming such oxides by heating, for example, $CaCO_3$ or $MgCO_3$ can be used. In addition, $Y_2O_3$ or oxides of rare elements may also be used.

The heat generating resistor can be formed by printing a pattern of a predetermined shape by sintering a conductive paste mainly containing tungsten, molybdenum and platinum by a thick film printing method on a green material to be formed as a ceramic substrate by sintering and then sintering them integrally. Further, rhodium or the like may be used in admixture with these ingredients. Tungsten, molybdenum, platinum and rhodium described above may also be used alone. By the use of platinum or rhodium alone, the resistance characteristic can be improved.

The heat generating resistor has a heat generating portion and a lead portion. The heat generating resistor in the present invention can be formed, for example, into a shape as shown in FIGS. 1, 2 and 3. In each of the Figures, A is a heat generating portion and B is a lead portion. However, the shapes for the heat generating portion and the lead portion are not restricted only to those in the Figures. By the change of the shape and the ingredient for the heat generating portion and the lead portion, the ratio of the electric resistivity of each of the portions in the heat generating resistor can be controlled.

Further, resistance is measured under a normal atmospheric temperature. Normal temperature is defined as 18° to 30° C. (particularly, 20° to 25° C.). Further, measurement is conducted by a milli-ohm, high tester. Since the electric resistance is different depending on the ingredients and the shape of the heat generating portion and the lead portion as described above, the maximum resistance value measured for the heat generating portion and the lead portion under the conditions described above is determined as the electric resistances for each of them. That is, if the measuring value of the electric resistance is different, for example, between the longitudinal direction and the lateral direction, a greater resistance value is defined as the electric resistance.

Assuming the sum for the entire electric resistance of the heat generating portion and the lead portion is 100%, the fraction of the electric resistance of heat generating portion is from 55 to 95%, preferably, is from 60 to 93% and, more preferably, is from 68 to 90%.

If the electric resistance of the heat generating portion is less than 55%, the temperature elevation rate in the heat generating portion is low and it can not be used as an automobile oxygen sensor. It is also not preferred since the lead portion generates excessive heat. On the other hand, if the ratio of the electric resistance of the heat generating portion exceeds 95%, although the temperature elevation rate is high, the durability of the heater may sometimes be reduced by excess heat generation. Further, in order to prevent excess elevation of temperature, it may sometimes require other specific means or devices.

The ratio of the electric resistance for the heat generating portion and the lead portion in the invention can be controlled easily by changing the shape of the lead portion. That is, the fraction of the electric resistance for the heat generating portion is preferably from 55 to 80% (more preferably, from 55 to 77% and further preferably, from 55 to 75%) by changing the shape of the lead portion, thereby increasing the electric resistance of the lead portion. The electric resistance of the lead portion can be increased by the shape of the lead portion, for example, by forming slits in the lead portion as shown in FIG. 1 thereby decreasing the cross sectional area for passing an electric current therethrough. The portion may have a shape not only a rectangular shape as shown in the figure but also any other shape such as a circular shape or a trigonal shape. The electric resistance can also be increased by changing the length of the lead portion. If the lead portion has a shape with high electric resistance, the ratio of the electric resistance of the heat generating portion can be decreased to improve the durability of the heat generating portion. Accordingly, a ceramic heater having such a heat generating resistor can provide stable performance over a long period of time.

Further, by disposing slits to the lead portion, many portions not covering the substrate by the lead portion are formed. In this case, since the ceramic substrates which receive the lead portion therebetween are in direct contact with each other, adhesion between the ceramic substrate is improved remarkably. The slits are preferably disposed uniformly over the entire surface of the lead portion. This can further improve the adhesion of the ceramic substrates in the vicinity of the lead portion over the entire surface. Preferably, the width of the slit or slits is about ⅓ of the total width of the respective lead portion.

Preferably, a single slit is provided in each lead portion, and the slit width is about the same as the width of each separated lead portion on either side of the slit.

Advantageously, the ratio of the electric resistance of the heat generating portion can be a fraction of from 70 to 95% (more preferably, from 77 to 93% and, further preferably, from 75 to 90%) by changing the shape of the lead portion. A lead portion with such a shape of low electric resistance can be formed, for example, by forming it entirely with a resistor material and increasing the cross sectional area for passing the electric current as shown in FIG. 2. In addition, the electric resistance can also be controlled by the length of the lead portion. By increasing the ratio of the electric resistance of the heat generating portion, the temperature of the ceramic heater can be elevated rapidly.

The resistance value of the heat generating portion can be increased or decreased not only by changing the shape of the lead portion, but also by changing the shape of the heat generating portion in the same manner, thereby changing the ratio of the electric resistance of the heat generating portion relatively to the lead portion to obtain the preferred ratio of the electric resistance as described above.

The ratio of the length of the heat generating portion to the length of the lead portion, i.e. the ratio A:B shown in FIGS. 1, 2 and 3, is preferably in the range of from 1:12 to 28:23, particularly for a circular rod type (tubular) heater such as for a sensor as shown in FIG. 5.

Preferably, the total resistance of the heat generating portion and the lead portion is in the range from 2 to 18 Ω advantageously for a circular rod type heater for an oxygen sensor as shown in FIG. 5.

Preferably, such a heat generating resistor is formed with platinum. The ceramic heater has a high heat resistance, rapidly elevates the temperature and has excellent durability. Advantageously, the heat generating resistor can be formed with platinum and an ingredient constituting the ceramic substrate. The ingredient constituting the ceramic substrate incorporated in the heat generating resistor is contained in an amount preferably from 1 to 30% (more preferably, from 3 to 20%) based on 100% of the entire heat generating resistor. If the content of the ingredient constituting the heat generating resistor is less than 1%, adhesion between the ceramic substrate and the heat generating resistor may not sometimes be improved sufficiently. Further, if it exceeds 30%, it is not preferred since the strength of the heat generating resistor is lowered and the durability of the heater is sometimes insufficient.

Preferably, the heat generating resistor described above can be formed with tungsten. This ceramic heater also has excellent characteristics.

Preferably, as well, the heat generating resistor can contain at least one of alumina, tungsten and molybdenum and the heat generating resistor may contain from 3 to 30% of alumina based on 100% of the heat generating resistor. This heat resistivity is improved more by the use of tungsten and/or molybdenum. The ceramic heater also has excellent characteristics.

Preferably, the heat generating resistor may further contain rhenium with a content thereof from 5 to 40%. Since rhenium has a smaller resistivity at normal temperature and a smaller temperature coefficient of resistance compared with tungsten or the like, the electric resistance does not increase remarkably even if the temperature is elevated. Accordingly, by the incorporation of an appropriate amount of rhenium, a ceramic heater with a high temperature elevation rate, capable of suppressing an inrush current and which does not show excess temperature elevation exceeding a predetermined temperature can be obtained.

Further, since the heat expansion coefficient (rate) of tungsten, molybdenum or the like is greatly different from that of alumina, it is not always preferred in view of the joining strength and the stability of the performance of the heat generating resistor, the joining strength can be improved and the performance of the heat generating resistor can be stabilized by the coexistence of the rhenium. The content of rhenium is preferably from 8 to 35% and, particularly, from 10 to 30%. If the content is less than 5%, inrush current cannot be suppressed effectively and the density of the heat generating resistor is lowered if it exceeds 40%.

Referring to the electric resistance for the lead portion and the electric resistance for the heat generating portion of the heat generating resistor, the ratio of the electric resistances for them can be controlled by changing the shape of the lead portion and the heat generating portion. The ratio can also be changed depending on the material forming the heating generating resistor and the ingredient constituting the material. For instance, a heat generating resistor may comprise a heat generating portion containing rhenium and a lead portion not containing rhenium. This is because the resistance of the lead portion is increased by not containing rhenium, so that the lead portion consumes electric power at high temperature to suppress the saturation temperature in the heat generating portion and the ceramic heater can be kept easily at an appropriate temperature.

In addition, the ratio of the electric resistance for the heat generating portion and the lead portion can be controlled by various combinations, for example, by (1) forming the heat generating portion with tungsten and the lead portion with tungsten and molybdenum, (2) forming the heat generating portion with tungsten and molybdenum and the lead portion with tungsten, molybdenum and alumina, (3) forming the heat generating portion with tungsten and alumina and the lead portion with tungsten and molybdenum, (4) forming the heat generating portion with tungsten and rhenium and the lead portion with tungsten and molybdenum and (5) forming the heat generating portion with tungsten, rhenium and alumina and the lead portion with tungsten, molybdenum and alumina.

The heat generating portion and the lead portion constituting the heat generating resistor in the ceramic heater according to the invention can be formed by preparing a paste containing a predetermined ingredient, printing the same to a shape having a predetermined pattern, for example, by a thick-film printing method and then sintering the same. The paste can be prepared by mixing each of the powders of tungsten, molybdenum, platinum, rhenium and alumina at a predetermined amount and applying predetermined operations. It is preferred to use a powder having an average grain size from 0.4 to 2.5 $\mu$m (more preferably, from 0.6 to 2.0 $\mu$m) for tungsten and molybdenum, a powder having an average grain size from 0.4 to 5 $\mu$m (more preferably, from 1.0 to 4.0 $\mu$m) for rhenium and a powder having an average grain size from 0.1 to 2.5 $\mu$m (more preferably, from 0.5 to 2.0 $\mu$m) for alumina. Each of the powders having the average grain size of less than the lower limit value tends to scatter upon preparing the paste and is sometimes difficult to handle. Further, each of the powders in excess of the upper limit value is difficult to mix during preparation of the paste and the resistance value of the heat generating resistor after sintering is difficult to be made uniform, which is not preferred.

Further, when a heat generating portion and a lead portion each comprising different ingredients are formed, they can be formed by printing a portion to be the heat generating portion by sintering and a portion to be formed as a lead portion by sintering with two kinds of pastes and sintering them. However, for the overlap portion between the heat generating portion and the lead portion after sintering, pastes are printed preferably such that the length is within a range from 0.1 to 1 mm. If the length is less than 0.1 mm, it is not preferred since insufficient current can be conducted. Further, if the length exceeds 1 mm, it is not preferred since the length of the portion with thickness being increased by overlap is increased to sometimes make adhesion insufficient between it and the substrates for sandwiching the entire heat generating resistor.

The ceramic heater according to the present invention may be of any shape but, usually, it can be of three types as shown below: (1) a circular rod type ceramic heater as shown in FIG. 4, which is wound around a ceramic tube and having an outer shape of a circular rod, (2) a plate type ceramic heater not using the ceramic tube 3 in FIG. 4 and having a flat plate outer shape, (3) an integral type ceramic heater comprising a substrate having a solid electrolyte layer, buried in a substrate of a device, usually referred to as a thick-film oxygen sensor device. Further, the ceramic heater in (1) and (2) is inserted into a solid electrolyte of an oxygen sensor device of a bottomed cylindrical shape as shown in FIG. 5 and, further, inserted into a protector as shown in FIG. 6 for use. Since the ceramic heater in (3) is buried in the thick-film oxygen sensor device, the thick-film oxygen sensor device is inserted into a protector as shown in FIG. 7 for use.

Among them, for the circular rod type ceramic heater and the plate type ceramic heater, when a heater pattern to be formed as a heat generating resistor 2 is printed on a green sheet to be formed as a ceramic substrate 1*b* shown in FIG. 4 is printed, it is preferred to print the pattern at a position from four peripheral ends of the green sheet by more than 0.2 mm to a central portion (more preferably, further than 1 mm, more preferably, more than 5 mm). This can prevent the heat generating resistor 2 from extending beyond the substrates 1*a* and 1*b*.

Further, the end of the ceramic tube used in the circular rod type ceramic heater is preferably chamfered, particularly, rounded with the radius of curvature being preferably more than 0.2 mm. As shown in FIG. 5, this can prevent the end of the ceramic tube from being chipped by contact with the inner wall surface of the solid electrolyte when it is inserted into the solid electrolyte body. Further, since the ceramic tube is usually formed by an extrusion molding process, it is more preferably a tubular body which is easy to be extruded than a solid body. If this is a tubular body, force exerting on the molding product upon fabrication tends to be dispersed to obtain a homogeneous tubular molding product with less scattering of density. Further, the diameter for a the hollow portion of the tubular body is preferably from 10 to 40% of the diameter for the ceramic tube. If the ratio of the diameter of the hollow portion is less than 10%, it is difficult to withdraw a pin inserted for forming the hollow portion during extrusion molding and, if the pin is withdrawn with an excessive force, cracking may sometimes be caused to the molding product. Further, if the ratio of the diameter of the hollow portion exceeds 40%, the thickness of the molding product is reduced, which is not preferred since the strength is insufficient.

Further, when the heater pattern to be formed as the heat generating resistor is printed and a laminated green sheet is wound around the ceramic tube, the ratio of the thickness of the green sheet to be formed as a ceramic heater by sintering relative to the outer diameter of the ceramic tube is preferably from 0.04 to 0.20. If the ratio is less than 0.04, the durability is sometimes insufficient, whereas if it is exceeds 0.20, it is difficult to be wound and the operation efficiency is sometimes lowered. Further, in the circular rod type ceramic heater, it is preferred that the end of the ceramic substrate is wound at a position being apart by more than 0.2 mm (preferably, from 0.5 to 2 mm) from the end of the outer side of the ceramic tube toward the center of the ceramic tube. This can prevent the ceramic substrate from chipping due to contact with the inner wall surface of the solid electrolyte when the circular rod type ceramic heater is inserted into the solid electrolyzed.

The oxygen sensor of the invention incorporates a heat generating resistor as described above. If the ceramic heater of the heat generating resistor has a bottomed cylindrical solid electrolyte as a detection element, for example, the circular rod type ceramic heater or the plate type ceramic heater described above is usually used, and disposed to the inside of the solid electrolyte as the detection element. Further, in a case of using the ceramic heater as the oxygen sensor having the thick-film type oxygen sensor element as the detection element, it is usually buried in the substrate having the solid electrolyte.

It is therefore an object thereof to provide a ceramic heater having a high temperature elevation rate and capable of keeping a predetermined temperature after the high temperature has been reached, by controlling the ratio of the resistivity in the heat generating portion, for example, by specifying a shape of a lead portion of the heat generating resistor.

A further object of the present invention is to provide a ceramic heater of high durability by specifying the composition of a heat generating resistor and improving the adhesion of a ceramic substrates for sandwiching a heat generating resistor.

A still further object of the present invention is to provide an oxygen sensor using such a ceramic heater.

BRIEF DESCRIPTION OF THE DRAWINGS

Embodiments of the invention will now be described, by way of example only, with reference to the accompanying drawings, in which.

DETAILED DESCRIPTION OF THE INVENTION

The ceramic heater of the invention, of various shapes and a manufacturing method of a circular rod, cylindrical type or plate type ceramic heater are here presented as examples.

(I) Structure of Circular Rod Type Ceramic Heater

Figure 4:
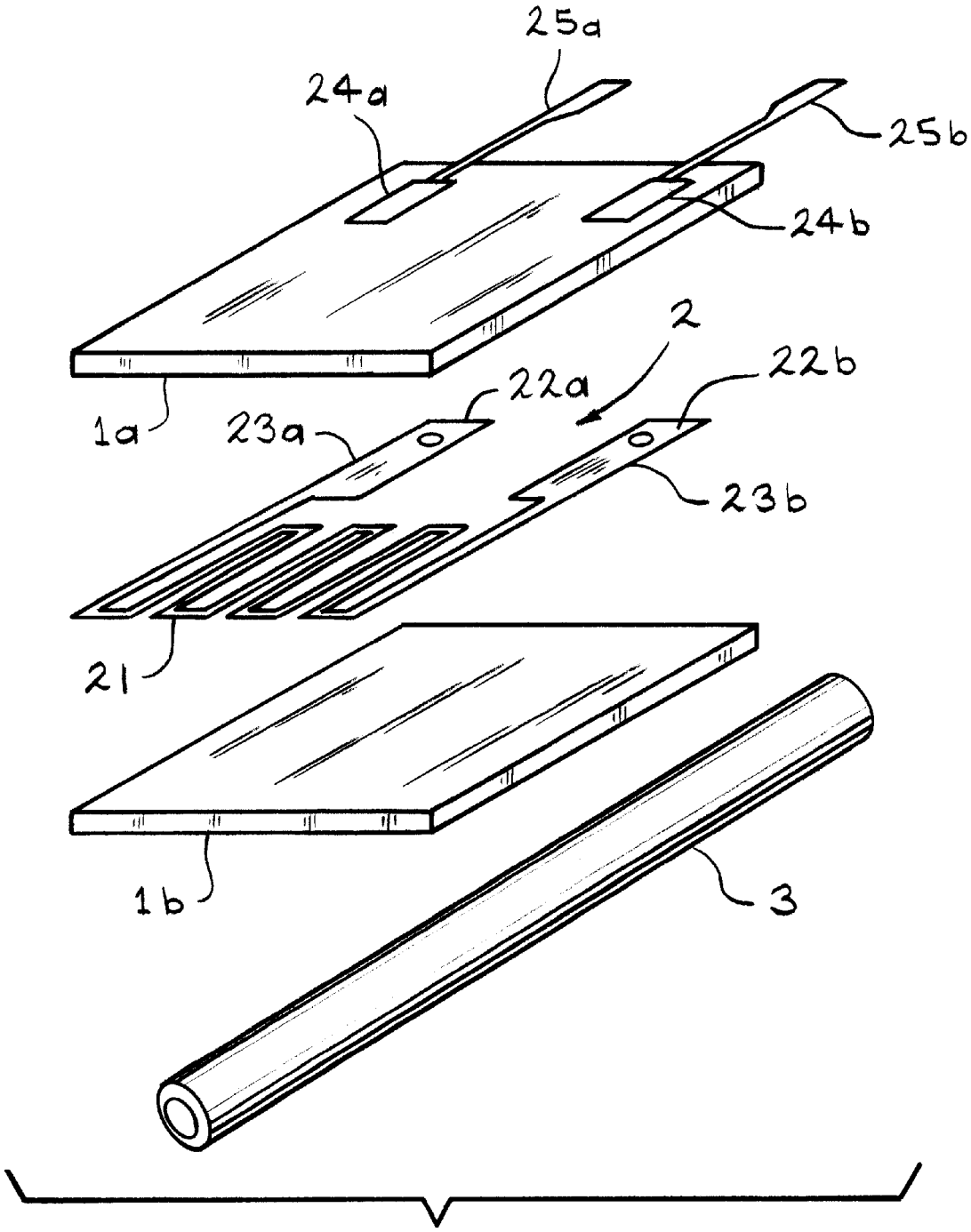
FIG. 4 is a perspective view showing an example of a ceramic heater manufactured by the method according to the present invention in an exploded and developed state.
Figure 5:
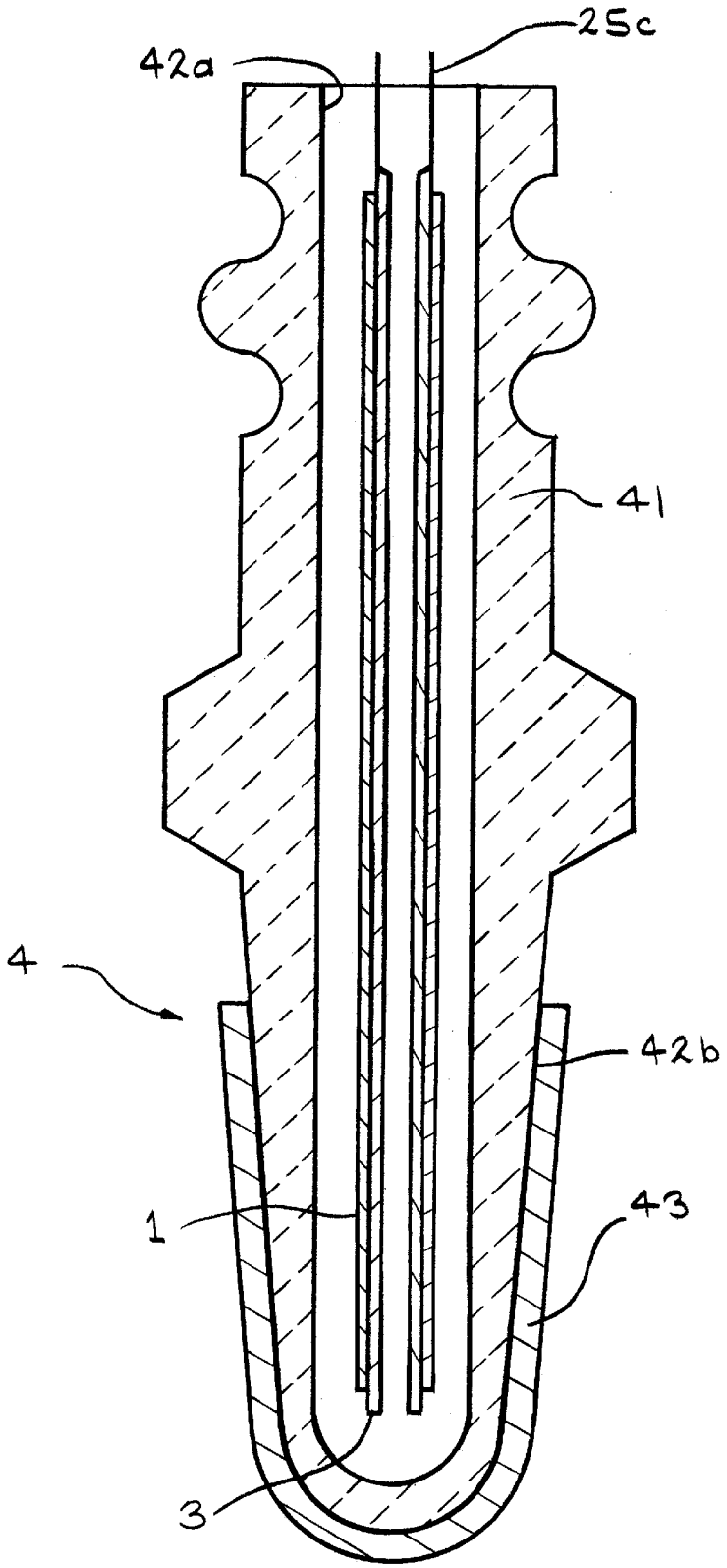
FIG. 5 is a cross sectional view schematically showing an oxygen sensor device in which a circular rod type ceramic heater is disposed inside a solid electrolyte of bottomed cylindrical shape.
Figure 6:
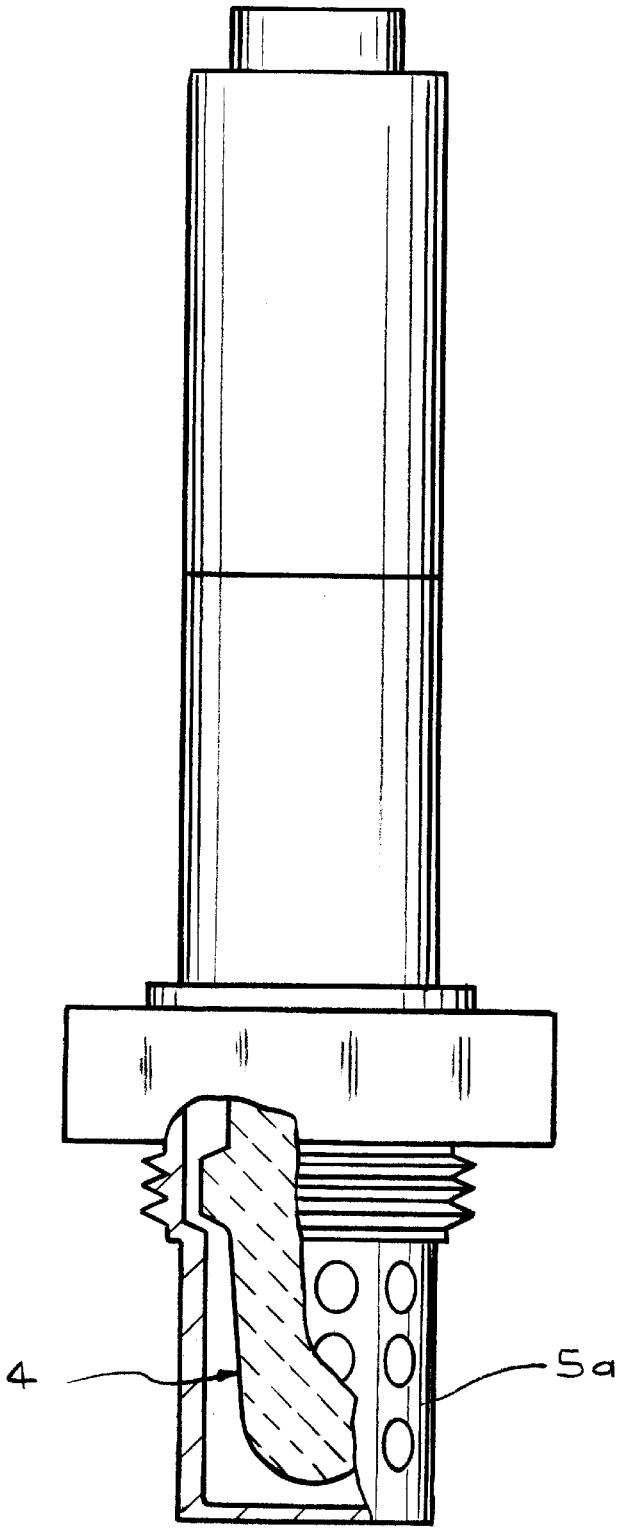
FIG. 6 is a partially cut away, cross sectional view schematically showing an oxygen sensor in which an oxygen sensor device of FIG. 5 is assembled.
Figure 7:
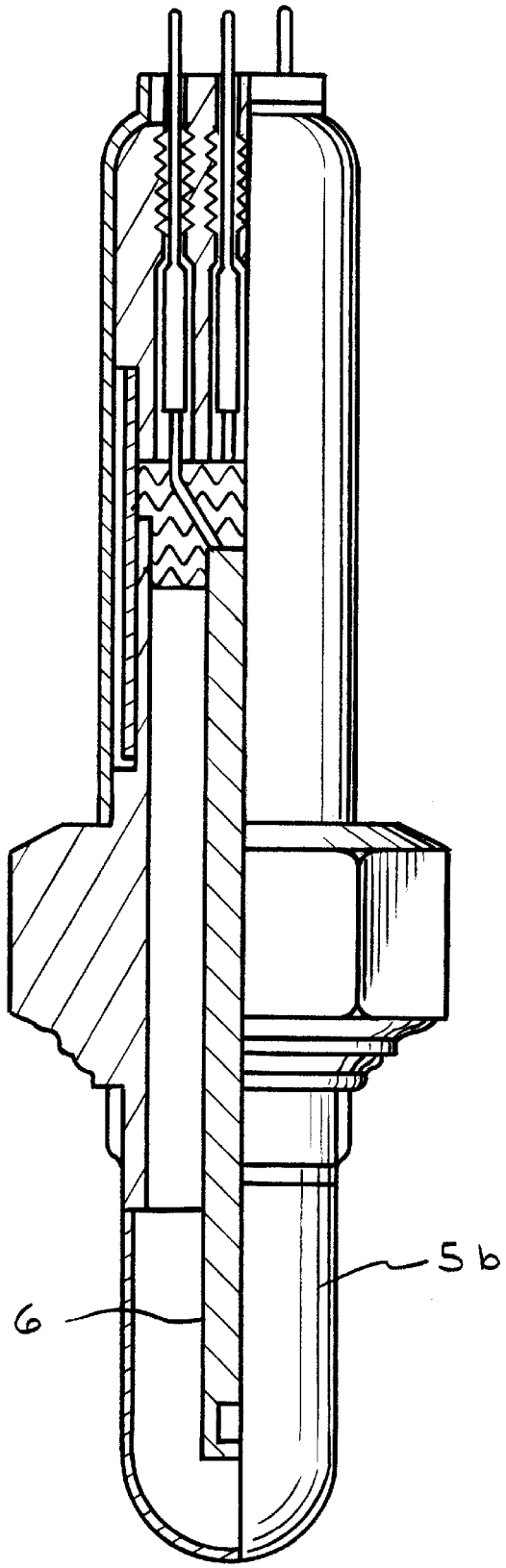
FIG. 7 is a partially cut away, cross sectional view schematically showing an oxygen sensor in which a thick-film type oxygen sensor provided with an integrated type ceramic heater is assembled.

FIG. 4 is a perspective view of a circular rod type ceramic heater in an exploded and developed state. The ceramic heater comprises ceramic substrates 1*a* and 1*b*, a heat generating resistor 2 disposed between the ceramic substrates, and a ceramic tube 3 on which the ceramic substrates 1*a* and 1*b* are wound integrally. The heat generating resistor 2 comprises a heat generating portion 21 at the top end, an anode end portion 22*a* and a cathode end portion 22*b* at the rear end, as well as lead portions 23*a* and 23*b* for connecting the heat generating portion 21 with both of the end portions 22*a* and 22*b*.

Further, conduction portions each having a conductive film formed on the wall surface of through holes are disposed at predetermined positions of the ceramic substrate 1*a* and an anode terminal portion 24*a* and a cathode terminal portion 24*b* are formed on the outer surface of the ceramic substrate 1*a* at positions corresponding to the conduction portions. Then, the anode end portion 22*a* is connected with the anode terminal portion 24*a* and the cathode end portion 22*b* is connected with the cathode terminal portion 24*b*, respectively, by the conduction portions. The ceramic tube 3 comprises alumina as the main ingredient, around which the ceramic substrate 1*a*, the heat generating resistor 2 and the ceramic substrate 1*b* are integrally wound and joined to the ceramic tube 3.

Figure 3:
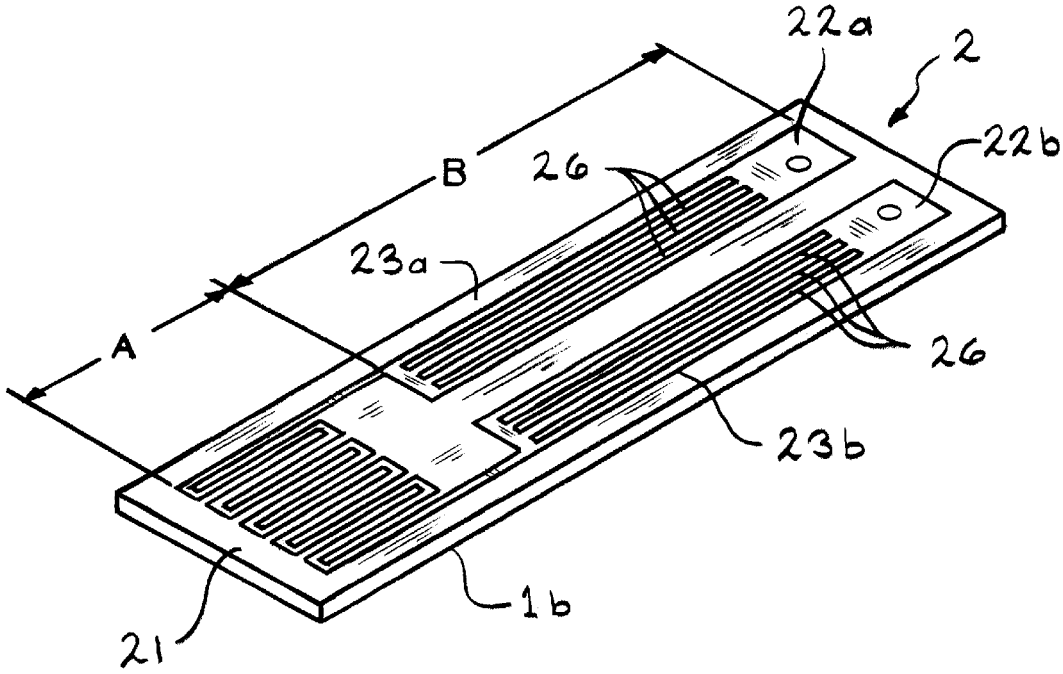
FIG. 3 is a perspective view of a heat generating resistor having a plurality of slits disposed on a lead portion.

FIG. 3 is a perspective view showing a heat generating resistor 2 of a ceramic heater corresponding to an embodiment of the invention according to claim 2. In this heater, each of the lead portions 23*a* and 23*b* is provided with three slits 26 having substantially the same length as the lead portion. Adhesion of the ceramic substrate 1*a* and 1*b* may be lowered depending on the content of rhenium. In such a case, lowering of the adhesion can be suppressed by using alumina as the same constituent with the ceramic substrate 1*a* and 1*b* together and disposing a plurality of slits 26 as shown in FIG. 3.

(II) Method of Manufacturing Circular Rod Type Ceramic Heater (1) Preparation of green sheet 93.5 parts of alumina powder (purity; 99.9%, average grain size; 1.5 $\mu$m), 5 parts of silica powder (purity; 99.9%, average grain size; 2.0 $\mu$m), 1 part of magnesia powder (purity; 99.9%, average grain size; 2.0 $\mu$m) and 1.5 parts of calcia powder (purity; 99.9%, average grain size; 2.0 $\mu$m) were wet mixed for 40 hours in a ball mill and then dewatered and dried.

Subsequently, 8 parts of polyvinyl butyral, 4 parts of butyl phthalate and 70 parts of a mixed solvent of methyl ethyl ketone and toluene were blended with the thus obtained powder mixture, and mixed in a ball mill to prepare a slurry mixture. Then, the mixture was defoamed under a reduced pressure to prepare a green sheet (a) of 0.3 mm thickness to constitute a ceramic substrate 1*a* by a doctor blade method. Further, a green sheet (b) of 0.2 mm thickness to constitute a ceramic substrate 1*b* was prepared in the same manner.

(2) Printing of heat generating resistor pattern and wiring pattern

A tungsten paste prepared by using a tungsten powder and ethyl cellulose and butyl carbitol as an organic binder was printed on one surface of the green sheet (a) by a thick-film printing method to form a heat generating resistor pattern of 25 $\mu$m thickness. The tungsten paste was coated to an inner wall surface of two through holes disposed in the green sheet (a) on which the heat generating resistor pattern was formed and a conductive film is formed to form a conduction portion. Further, the tungsten paste was printed on the other surface of the green sheet (a) at a position corresponding to the conduction portion by a thick-film printing method to form a wiring pattern for forming the anode and cathode terminal portions.

(3) Preparation of green material

The green sheet (b) was stacked at one surface on the surface of the green sheet (a) formed with the heat generating resistor pattern and they were press-bonded by heating and pressing by a press bonding device. Then, a paste prepared by blending polyvinyl butyral and butyl carbitol with alumina was coated on the other surface of the green sheet (b), which was wound around with the coating surface being on an inner side around the ceramic tube, and pressed at the outer circumference to prepare a green material to be formed as a circular rod type ceramic heater.

(4) Sintering

The green material prepared in (3) above was degreased by heating at 250° C. and then sintered being kept at 1550° C. for 90 minutes using a hydrogen furnace. In this way, the ceramic substrates 1*a* and 1*b*, the heat generating resistor 2, the anode and cathode terminal portions 24*a*, 24*b*, and the ceramic tube 3 were joined integrally. Then, nickel plating was applied to the anode and cathode terminal portions 24*a*, 24*b* and lead wire extending terminals 25*a*, 25*b* were by brazing material to obtain a circular rod type ceramic heater.

(III) Method of Manufacturing Plate Type Ceramic Heater (1) Preparation of green sheet 10 parts of polyvinyl butyral, 6 parts of dibutyl phthalate and 70 parts of a mixed solvent methyl ethyl ketone and toluene were blended with a powder mixture obtained in the same manner as in (II), (1) and mixed in a ball mill to prepare a slurry mixture. Then, the mixture was defoamed and under a reduced pressure to prepare a green sheet of 0.4 mm thickness for constituting a ceramic substrate and two green sheets to be formed as the ceramic substrate were cut out of the sheet.

(2) Preparation of paste comprising platinum and alumina 95 parts of a platinum powder and 5 parts of an alumina powder (purity; 99.9%, average grain size; 0.4 $\mu$m were mixed in an acetone solvent for 24 to 40 hours by using spheroidal alumina balls and a pot. Then, ethyl cellulose and butyl carbitol as an organic binder were added and they were mixed further for 5 hours. Then, they were defoamed and acetone was evaporated to obtain a paste comprising platinum and alumina.

(3) Printing of heat generating resistor pattern and wiring pattern

Figure 1:
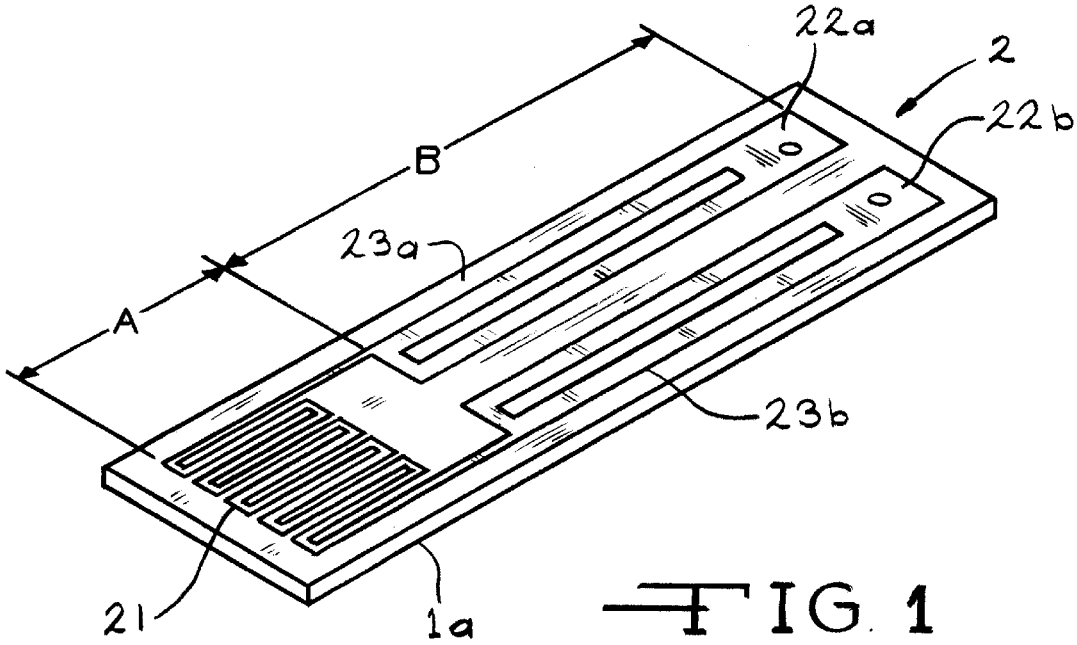
FIG. 1 is a perspective view of a heat generating resistor having slits disposed in a lead portion.

The paste was printed on one surface of one of green sheets obtained in (III), (1) by a thick-film printing method so as to provide a pattern shown in FIG. 1, to form a heat generating resistor pattern of 25 $\mu$m thickness. The paste was coated to the inner wall surface of two through holes formed in the green sheet as an electroconductive film to form conduction portions. Further, the paste was printed on the other surface of the green sheet at the position corresponding to the conduction portions by a thick-film printing method to form a wiring pattern to be formed as the anode and cathode terminal portions.

(4) Manufacture and sintering of green material

The other of the green sheets was stacked at one surface on the surface of the green sheet formed with the heat generating resistor pattern, they were press-bonded by heating and pressurizing by a press bonding device to form a green material to be formed as a plate type ceramic heater. Then, the green material was degreased by heating at 250° C. and then maintained and sintered at 1500° C. for 2 hours in atmospheric air. Then, nickel plating was applied to the anode and cathode terminal portions, respectively, and they were joined with lead wire extending terminals using a brazing material to obtain a plate type ceramic heater.

(IV) Evaluation for Ratio of Electric Resistance of Heat Generating Portion and Composition of Heat Generating Resistor Correlation between the ratio of the electric resistance and the saturation temperature and durability of the heat generating portion, as well as correlation between the composition of the paste for forming the heat generating resistor in (II), (2) and the adhesion of the ceramic substrate were investigated below. The evaluation method and the results are as shown below.

(1) Evaluation for ratio of electric resistance for heat generating portion

Circular rod type ceramic heaters controlled such that the fraction of the electric resistance for the heat generating portion was from 50 to 97% were prepared in the same manner as in (II), by setting the length of the heat generating portion of the heat generating resistor to 10 mm, varying the wire width of the heat generating portion (from 0.15 to 0.65 mm) and the number of the heat generating portions (from 4 to 12) and combining them such that the electric resistance thereof was within a range of 6±0.5 Ω. Pastes for forming the heat generating resistor comprising 88% by weight of tungsten and 12% by weight of alumina, and comprising 65% by weight of tungsten and 10% by weight of alumina and 25% by weight of rhenium were used.

The ratio of the electric resistance was distributed as described below. After printing and sintering the paste on an alumina substrate, the electric resistance of the entire pattern was measured by a milli-ohm high tester (manufactured by Hioki Co., the model 3227 milli-ohm high tester). The thus obtained resistance value is converted into a resistance value per unit volume using a cross sectional area and a surface area of the pattern. The area and the thickness for printing the paste to be formed as the heat generating portion and the lead portion are determined by using the resistance value per unit volume and a pattern giving a predetermined ratio of the electric resistance is formed.

A voltage at 14 V was applied to the thus obtained circular rod type ceramic heaters, and the surface temperature was measured by a thermotracer. The results are shown in Table 1. In Table 1, the saturation temperature higher than 500° C. is indicated by "O" and lower temperature is indicated by "X". The durability is indicated by "O" for the resistance increasing ratio of less than 30% and by "X" for the resistance increasing ratio in excess of 30%, when the circular rod type ceramic heaters were contained in a sintering furnace set at 1000° C., and applied with a voltage at 17 V, and no disconnection was observed for the heat generating resistor after 200 hours. The symbol Δ denotes a borderline result.

TABLE 1

| Experimental Example | Resistance ratio (%) for heat generating portion | Saturation temperature | Durability | Overall evaluation |
|---|---|---|---|---|
| 1 | 50 | X | O | X |
| 2 | 58 | Δ | O | Δ |
| 3 | 68 | O | | O |
| 4 | 80 | | | |
| 5 | 90 | | | |
| 6 | 97 | O | X | X |

It can be seen from the results of Table 1 that the fraction of the electric resistance for the heat generating portion constitutes 55 to 95% to the electric resistance for the entire heat generating resistor and, the heater of Experimental Example 2 shows a somewhat lower performance but heaters of Experimental Examples 3 through 5 show a saturation temperature in excess of 500° C. and have excellent durability, in the circular rod type ceramic heater corresponding to the invention. On the other hand, in the circular rod type ceramic heater of Experimental Example 1 with a low electric resistance ratio for the heat generating portion, the temperature does not reach 500° C. while, in the circular rod type ceramic heater of Experimental Example 6 with the higher ratio, the temperature is elevated in large excess of 500° C. and the durability is poor. The result, show a similar tendency irrespective of the kinds of the pastes.

(2) Evaluation for composition of heat generating resistor

A tungsten powder (purity: 99.9%, average grain size; 1.2 μm, an alumina powder (purity; 99.9%, average grain size; 1.5 μm and a rhenium powder (purity; 99.9%, average grain size; 3.5 μm) were weighed each by a predetermined amount so as to provide a paste composition shown in Table 2, and mixed with addition of acetone in an alumina pot using both. Then, acetone was removed by evaporation, and mixed with addition of ethyl cellulose and butyl carbitol as an organic binder for 24 hours, to prepare a paste having a predetermined viscosity.

Adhesion was evaluated by measuring the amount of helium gas leaked. Each of heaters not joined with the lead wire extending terminal was cut in a lateral direction at a lead portion, and an amount of helium gas leaked between the conduction portion and the cut face was measured. Heaters with an amount of leakage of $10^{-7}$ torr or more are indicated by "O" and those of $10^{-7}$ torr or less are was indicated as "X". Further, the durability was evaluated by applying a voltage at 16 V to each of the heaters in an atmosphere at 800° C. and heaters showing the resistance change of the heat generating resistor within 30% before starting current supply and after elapse of 24 hours are indicated by "O" and those in excess of 30% are indicated by "X".

TABLE 2

| Experimental Example | Paste composition $Al_2O_3$ (wt %) | Re (wt %) | W (wt %) | Adhesion | Durability |
|---|---|---|---|---|---|
| 7 | 0 | — | 100 | X | X |
| 8 | 1 | | 99 | | |
| 9 | | 5 | 94 | | |
| 10 | 2 | — | 98 | | |
| 11 | 3 | — | 97 | O | O |
| 12 | 5 | | 95 | | |
| 13 | | 40 | 55 | | |
| 14 | 8 | 32 | 60 | O | O |
| 15 | 11 | 25 | 64 | | |
| 16 | 30 | — | 70 | | |
| 17 | | 5 | 65 | | |
| 18 | 35 | — | 65 | | X |

It can be seen from the results in Table 2 that heaters excellent both in the adhesion and durability are obtained in Experimental Examples 11 through 17 corresponding to embodiments of the invention according to claims 7 and 8. On the other hand, the heater of Experimental Example 7 containing neither alumina or rhenium is poor in the adhesion, and heaters of Experimental Examples 8 through 10, although containing at least one of alumina and rhenium, but at the content of less than the lower limit value in the claims 7 and 8 the adhesion is also poor. Further, in the heater of Experimental Example 18 containing alumina by more than the upper limit value in claim 7, the durability is lowered although the adhesion is improved satisfactorily.

(3) Evaluation for the pattern shape in the lead portion of the heat generating resistor Circular rod type ceramic heaters each controlled for ratio of the electric resistance were prepared by setting the length of the heat generating portion of the heat generating resistor to 10 mm and varying the wire width of the heat generating portion (from 0.15 to 0.65 mm) such that the electric resistance was within a range of 6±0.5 Ω and by varying the pattern shape for the lead portion. The compositions in Experimental Examples 14 and 15 shown in Table 2 were used as the pastes for forming the heat generating resistor. The electric resistance was distributed in the same manner as in (IV), (1) described above.

Figure 2:
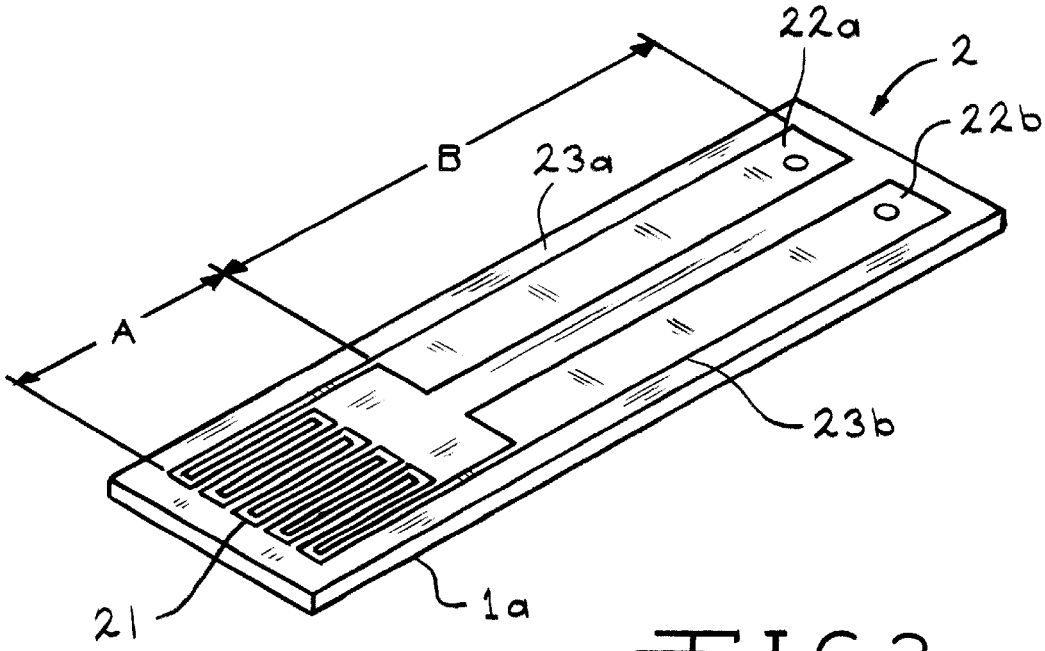
FIG. 2 is a perspective view of a heat generating resistor not having slits disposed in a lead portion.

A voltage at 14 V was applied to the thus obtained ceramic heaters and the surface temperature was measured by a thermotracer. The results are shown in Table 3. In Table 3, the saturation temperature higher than 500° C. is indicated by "O" and the lower temperature is indicated by "X". Further, for the lead portion pattern, $S_0$ is a lead portion as shown in FIG. 2 not formed with a slit, $S_1$ is a lead portion as shown in FIG. 1, formed with slits and divided into two fine wires, and $S_2$ is a lead portion as shown in FIG. 3 divided into four fine wires.

TABLE 3

| Experimental Example | Pattern shape for lead portion | Paste composition | Resistance ratio (%) for heat generating portion | Saturation temperature |
|---|---|---|---|---|
| 19 | $S_0$ | Experimental Example 15 | 91 | O |
| 20 | | Experimental Example 14 | | |
| 21 | $S_1$ | Experimental | 85 | |
| 22 | $S_2$ | Example 15 | 48 | |

It can be seen from the results of Table 3 that heaters of high saturation temperature and excellent performance can be obtained in Experimental Examples 19 to 21 corresponding to embodiments of the invention according to claims 1 to 3. On the other hand, the heater of Experimental Example 22 with the resistance ratio for the heat generating portion being less than 55% as the lower limit value of the invention showed saturation temperature lower than 500° C.

(4) Evaluation for temperature elevation rate of heat generating resistor of having heat generating portion and lead portion different compositions Pastes were prepared in the same manner as in (II), (2) described above, and heat generating resistors of different compositions for the heat generating portion and the lead portion as shown in Table 4 were formed. A voltage at 14 V was applied to the heat generating resistors, and the surface temperature of the heaters was measured by a thermotracer. Those reaching 800° C. within 10 seconds after application of the voltage is indicated by "O" and those not capable of reaching 800 within 10 seconds is indicated by "X" in Table 4.

TABLE 4

| | Heat generating portion | | Lead portion | | | | | |
|---|---|---|---|---|---|---|---|---|
| | Pattern | | | Paste composition | | | | Temperature |
| Experimental Example | length (mm) | Paste composition | Pattern shape | W (wt) | Mn (wt %) | Re (wt %) | $Al_2O_3$ (wt %) | elevation characteristics |
| 23 | 4 | Experimental | $S_0$ | 50 | 50 | — | — | O |
| 24 | | Example 15 | $S_1$ | 80 | 20 | | | O |
| 25 | | | | 90 | 10 | | | |
| 26 | 5 | Experimental | $S_0$ | 80 | 10 | | 10 | O |
| 27 | | Example 14 | | 90 | 5 | | 5 | O |
| 28 | 4 | Experimental | | 80 | — | 15 | 5 | X |
| 29 | | Example 15 | | 80 | 10 | 10 | 5 | X |

As shown in Table 4, the temperature reached 800° C. within 10 seconds after the application of voltage in Experimental Examples 23 to 27. Further, the temperature could not reached 800° C. within 10 seconds in Experimental Examples 28 and 29. That is, it can be seen that the surface temperature of the heaters increases rapidly in Experimental Examples 23 to 27 corresponding to embodiments of the invention according to claims 1 to 9, whereas the temperature could not reach 800 within 10 seconds just after the application of the voltage at 14 V in Experimental Example 28 and 29 which are out of the range of embodiments of the invention according to claim 7.

(V) Evaluation for Scattering of Resistance Value of Heat Generating Resistor When Grain size of Rhenium was Changed Pastes were prepared from the same powders, grain size (three types of grain size of rhenium of 2 μm, 3.5 μm and 5.5 μm were used) and blending ratio as those in Experimental Example 15 shown in Table 2 prepared in (IV), (2) were prepared. A heat generating portion of 4 mm length×0.026 mm width×25 μm (±2 μm) thickness was printed by the pastes on each of alumina substrates and then they were sintered to prepare specimens comprising only the heat generating portions each for 30 pieces, namely, 90 pieces in total. The resistance value for each of the specimens was measured by the milli-ohm high tester in the same manner as described above, a standard deviation σ was calculated for each of the three kinds of ceramic heaters based on the measured value, and scattering of the resistance value was evaluated by means 3σ, namely, three times the value of σ. As the value 3σ is greater, the scattering is larger.

The results are as shown below

| Grain size of rhenium | 2 μm | 3.5 μm | 5.5 μm |
|---|---|---|---|
| 3σ | 0.38 | 0.55 | 0.89 |

That is, it can be seen that as the grain size of rhenium is larger, the scattering of the resistance value is greater.

(VI) Evaluation for Thickness of Green Sheet Upon Preparing a Circular Rod Type Ceramic Heater Green sheets of different thickness were prepared by a doctor blade method in the same manner as in (II), (1). A heat generating resistor was printed on each of the green sheets by using the paste of the same composition as prepared in (II), (2) by a thick-film printing method such that the length of the heat generating portion was 20 mm, and the resistance value was 6±0.5 Ω. Then, the green sheet was adhered by pressing and sintered to obtain 10 types of green materials of different thickness to be formed as ceramic heaters by sintering. After winding the green materials around two kinds of ceramic tubes of different outer diameter (outer diameter of 2000 μm and outer diameter of 2500 μm), they were sintered in the same manner as in (II), (4) to obtain 19 types of circular rod type ceramic heaters.

For each of the circular rod type ceramic heaters, a voltage at 25.5 V was applied at a room temperature and durability of the heat generating resistors was evaluated. Further, each of the circular rod type ceramic heaters was pigmented using a red colorant capable of dying cracks and creases, to evaluate presence or absence of cracks caused by winding. The results are shown in Table 5. In the column for the durability in the table, "X" indicates that the heat generating resistor was disconnected within 50 hours and "O" indicates that there was no change by the application for more than 50 hours. Further, in the column for the occurrence of cracks, "O" indicates no coloration and "X" indicates observation of cracks.

TABLE 5

| | | Sheet thickness (μm) | Ratio | Durability | Crack |
|---|---|---|---|---|---|
| Experimental Example | 30 | 50 | 0.020 | X | O |
| | 31 | | 0.025 | | |
| | 32 | 100 | 0.040 | O | |
| | 33 | | 0.050 | | |
| | 34 | 150 | 0.060 | | |
| | 35 | | 0.075 | | |
| | 36 | 200 | 0.080 | | |
| | 37 | | 0.100 | | |
| | 38 | 250 | 0.100 | | |
| | 39 | | 0.125 | | |
| | 40 | 300 | 0.120 | | |
| | 41 | | 0.150 | | |
| | 42 | 350 | 0.140 | | |
| | 43 | | 0.175 | | |
| | 44 | 400 | 0.160 | | |
| | 45 | | 0.200 | | |
| | 46 | 450 | 0.200 | | |
| | 47 | | 0.250 | | X |
| | 48 | 500 | 0.220 | | X |

It can be seen from the results that circular rod type ceramic heaters having sufficient durability with no occurrence of cracks can be obtained if the ratio of the outer diameter of the ceramic tube to the thickness of the green sheet is from 0.04 to 0.20.

The present invention is not restricted to the specific examples described previously but may be made into variously modified embodiments within the scope of the present invention in accordance with the object and use. That is, the composition of the paste is not restricted only to those shown in the embodiments but, in addition, ingredients such as zirconia may also be incorporated. Further, the ceramic tube used upon manufacturing the circular rod type ceramic heater may not be restricted only to the tubular shape but it may be a solid body.

According to the invention, a ceramic heater having high temperature elevation rate and being excellent in durability can be obtained by specifying the ratio of the electric resistance for the heat generating portion of the heat generation resistor. Further by forming a heat generating resistor having a specified composition, excellent ceramic heaters can be obtained such that the adhesion of the ceramic substrates sandwiching the heat generating resistor can be improved. Further, an oxygen sensor of excellent performance can be obtained by using the ceramic heater according to the invention.

The foregoing disclosure is the best mode devised by the inventors for practicing this invention. It is apparent, however, that apparatus and methods incorporating modifications and variations will be obvious to one skilled in the art of ceramic heaters. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

What is claimed is:

1. A ceramic heater comprising, in combination, a ceramic substrate and a heat generating resistor disposed in or on said ceramic substrate, the heat generating resistor having a heat generating portion and a lead portion, and wherein the ratio of electric resistance of the heat generating portion to the total electric resistance of the heat generating portion and the lead portion, at a normal temperature, is from 55 to 95% and the ratio of the length of the heat generating portion to the length of the lead portion is in the range of from 1:12 to 28:23.

2. A ceramic heater as defined in claim 1, wherein said ratio of the electric resistance of the heat generating portion is from 55 to 80%.

3. A ceramic heater as defined in claim 1, wherein said ratio of the electric resistance of the heat generating portion is from 70 to 95%.

4. A ceramic heater as defined in claim 1, wherein the heat generating resistor comprises platinum.

5. A ceramic heater as defined in claim 1, wherein the heat generating resistor comprises platinum and an ingredient constituting the ceramic substrate.

6. A ceramic heater as defined in claim 1, wherein the heat generating resistor comprises tungsten.

7. A ceramic heater as defined in claim 1, wherein the heat generating resistor contains at least one of alumina, tungsten and molybdenum, and in which alumina comprises from 3 to 30% by weight of the heat generating resistor.

8. A ceramic heater as defined in claim 7, wherein the heat generating resistor further contains rhenium constituting 5 to 40% by weight.

9. A ceramic heater as defined in claim 8, wherein the lead portion of the heat generating resistor contains no rhenium.

10. A ceramic heater as defined in claim 1, wherein at least one slit is provided in the lead portion of the heat generating resistor.

11. A ceramic heater as defined in claim 1, wherein the total resistance of the heat generating portion and the lead portion is in the range of from 2 ohms to 18 ohms.

12. The ceramic heater as defined in claim 1 and further including an oxygen sensor.

* * * * *